US008297480B2

(12) United States Patent
Soon

(10) Patent No.: US 8,297,480 B2
(45) Date of Patent: Oct. 30, 2012

(54) AIR-PUMP TYPE DISCHARGER AND DISPENSER FOR DAILY NECESSARIES INCLUDING THE SAME

(76) Inventor: Byoung Moon Soon, Youngin-si (KR)

( * ) Notice: Subject to any disclaimer, the term of this patent is extended or adjusted under 35 U.S.C. 154(b) by 429 days.

(21) Appl. No.: 12/663,386

(22) PCT Filed: Jun. 5, 2008

(86) PCT No.: PCT/KR2008/003153

§ 371 (c)(1),
(2), (4) Date: Dec. 7, 2009

(87) PCT Pub. No.: WO2008/150115

PCT Pub. Date: Dec. 11, 2008

(65) Prior Publication Data

US 2010/0170921 A1 Jul. 8, 2010

(30) Foreign Application Priority Data

Jun. 7, 2007 (KR) ..... 10-2007-0055465

(51) Int. Cl.
*B65D 83/00* (2006.01)

(52) U.S. Cl. ..... 222/389; 222/401

(58) Field of Classification Search ..... 222/383.1, 222/386, 389, 400.8, 401; 92/181 P, 181 R; 169/33; 184/39; 604/141, 142, 143, 146
See application file for complete search history.

(56) References Cited

U.S. PATENT DOCUMENTS 1,027,133 A * 5/1912 Lawrence ..... 239/321
1,106,144 A * 8/1914 Harrison ..... 222/192
1,751,128 A * 3/1930 Cocks ..... 222/327
2,329,917 A * 9/1943 Lautmann ..... 222/209
2,382,314 A * 8/1945 Herb ..... 401/150
5,115,948 A * 5/1992 Johnson ..... 222/209
5,368,206 A * 11/1994 Sandrin ..... 222/326
6,234,360 B1 * 5/2001 Bockmann et al. ..... 222/327

FOREIGN PATENT DOCUMENTS

DE 3202275 A1 * 8/1983
JP 60-188177 12/1985
JP 2000-233152 A * 8/2000
KR 20-0393325 8/2005
KR 20-0393943 8/2005

* cited by examiner

*Primary Examiner* — Kevin P Shaver
*Assistant Examiner* — Patrick M Buechner
(74) *Attorney, Agent, or Firm* — Scully, Scott, Murphy & Presser, P.C.

(57) ABSTRACT

An air-pump type discharger capable of discharging a dose of contents, such as toothpaste, using pneumatic pressure and a dispenser for daily necessaries including the same are disclosed. The air-pump type discharger includes a housing inserted in a dispenser body, and provided with a plurality of air vent holes around a piston receiving portion formed on a bottom surface of the housing; a piston having a pushing part with an opened lower portion and inserted in an upper opening of the housing, and a connector extending from a bottom surface of the pushing part, inserted in the piston receiving portion, and contacting the bottom surface of the housing, in which an air passage is formed in the pushing part and the connector, through which air passes; and a spring, installed within the housing, for resiliently supporting the piston upwards. Since the discharger is easily detached from the dispenser body, the assembling workability and the recycle of resources can be improved.

6 Claims, 5 Drawing Sheets

[Fig. 1]
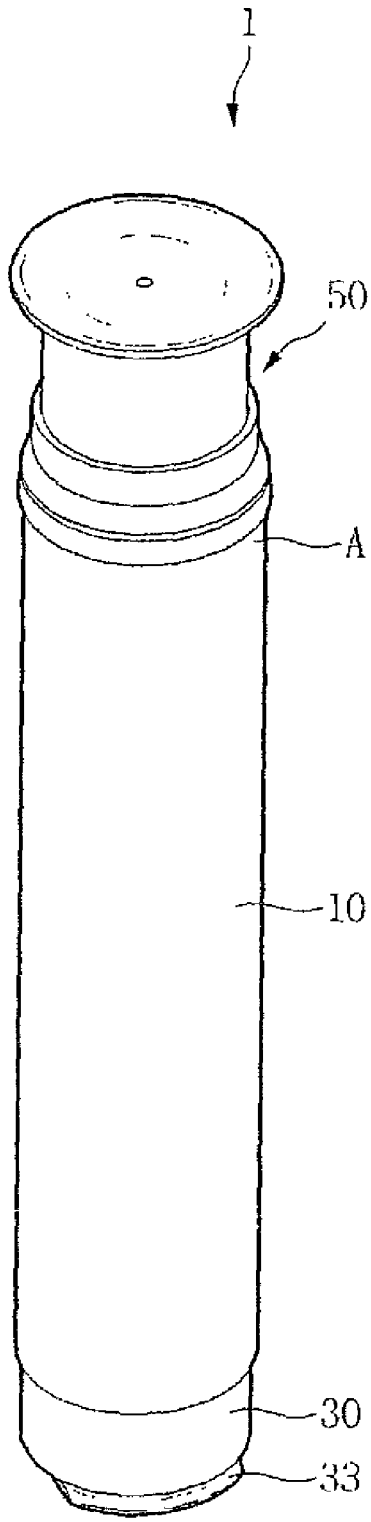

[Fig. 2]
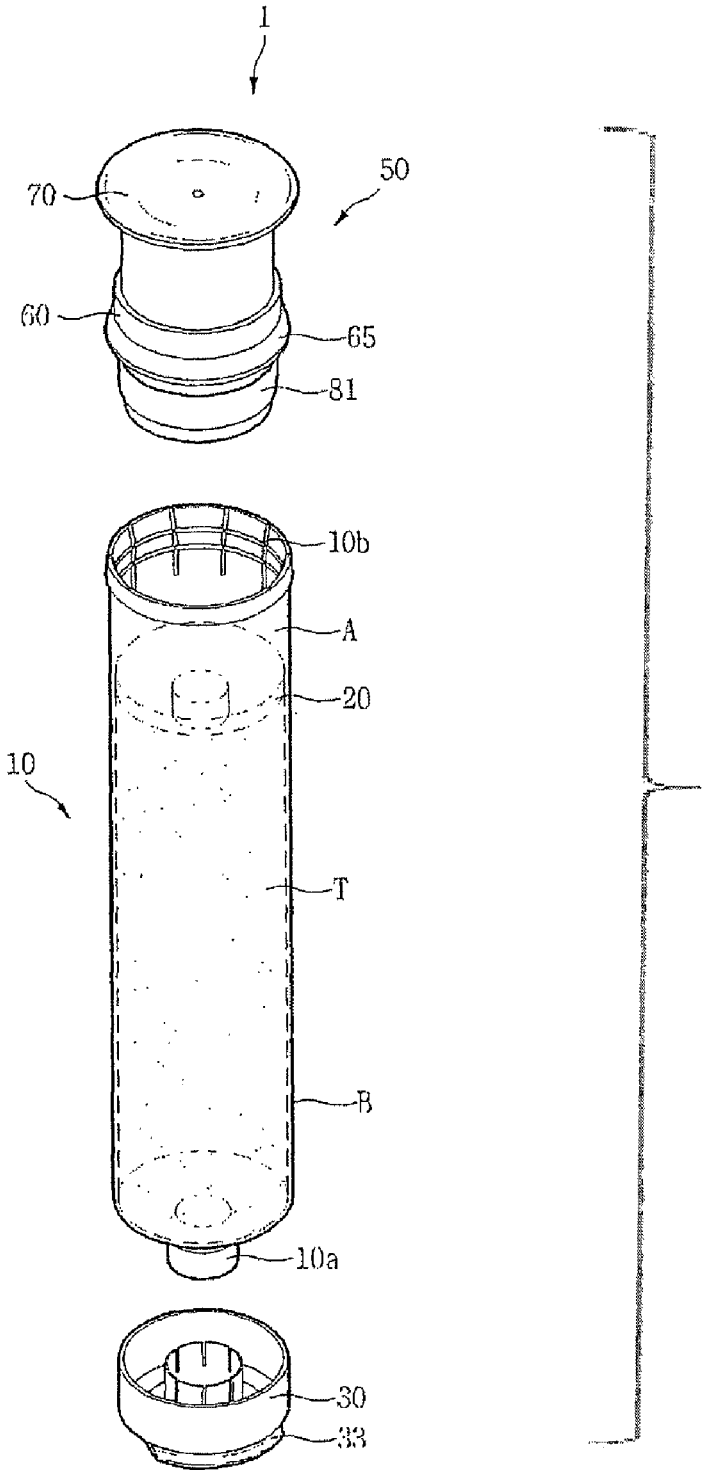

[Fig. 3]
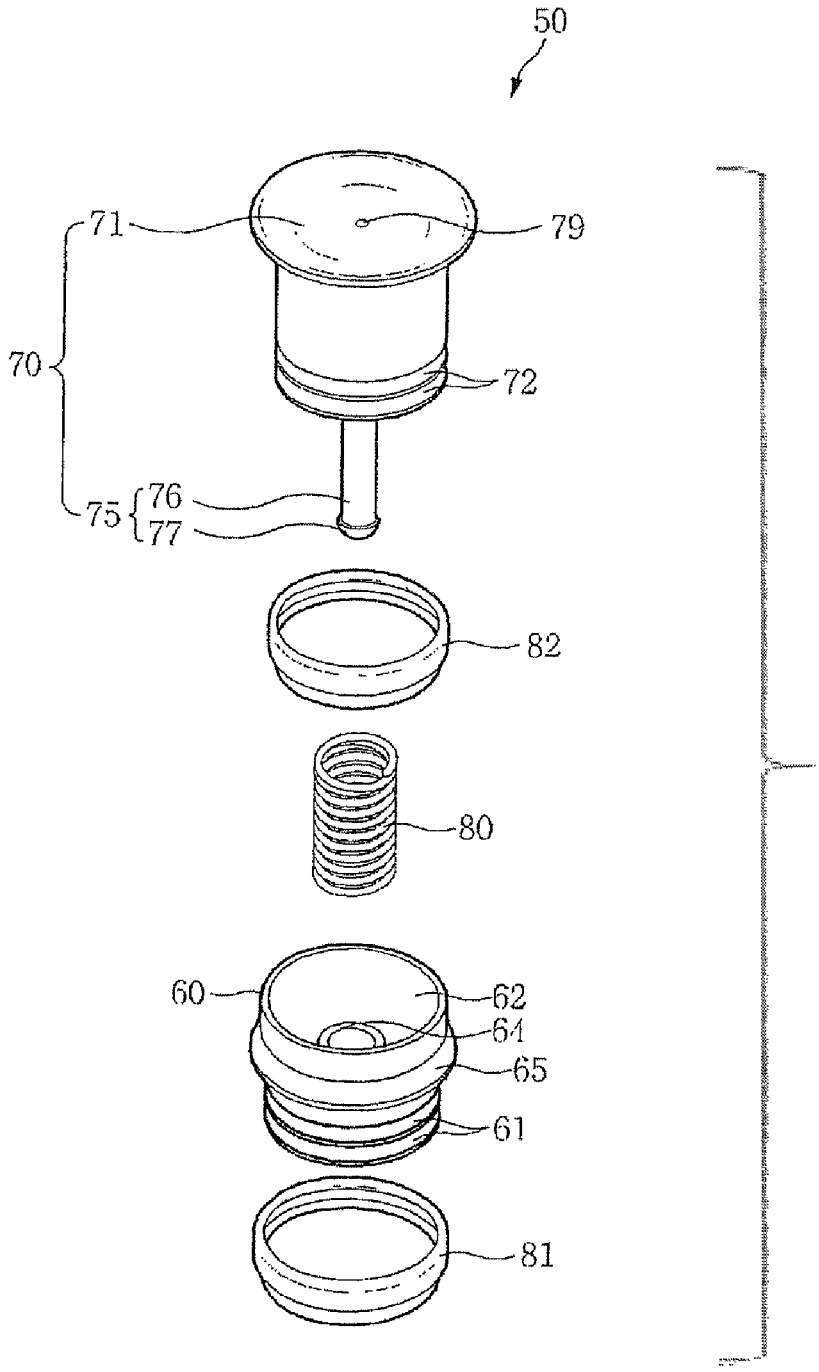

[Fig. 4]
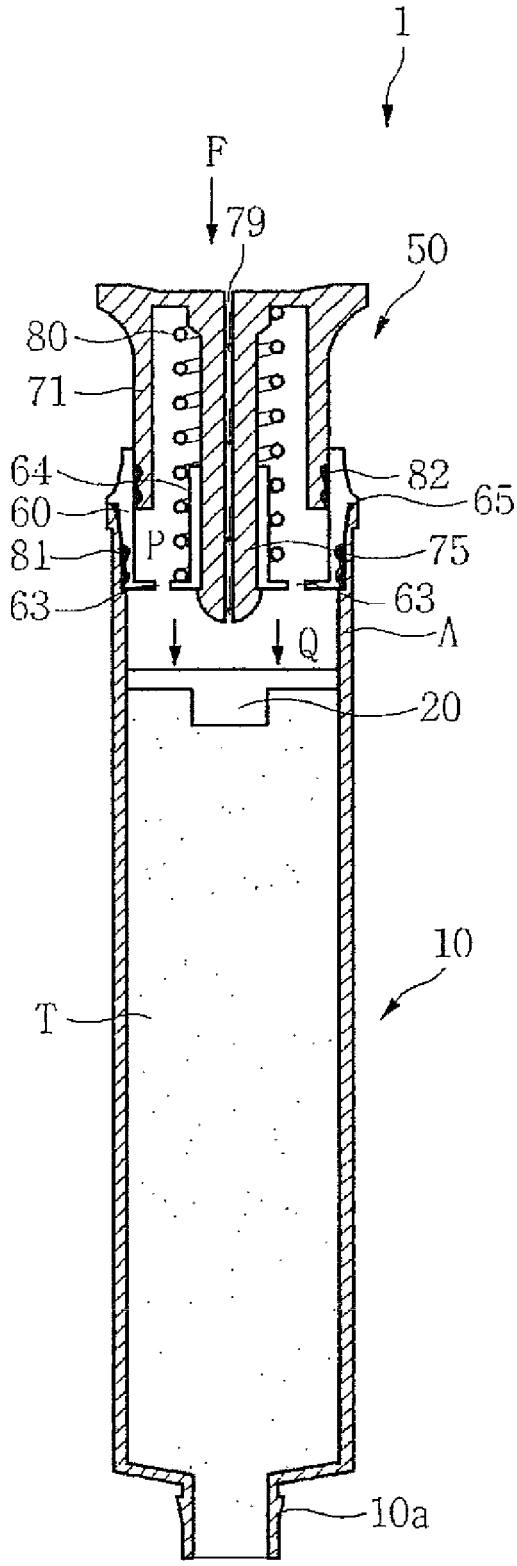

[Fig. 5]
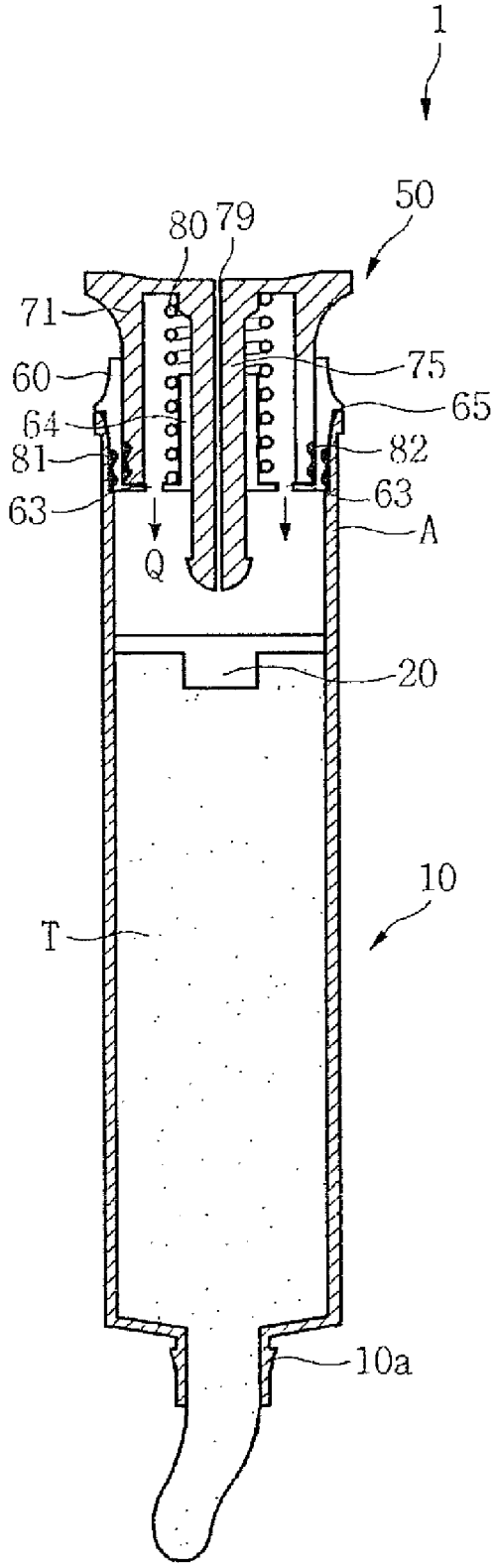

AIR-PUMP TYPE DISCHARGER AND DISPENSER FOR DAILY NECESSARIES INCLUDING THE SAME

TECHNICAL FIELD

The present invention relates to an air-pump type discharger and a dispenser for daily necessaries including the same, and more particularly to an air-pump type discharger capable of discharging a dose of contents, such as toothpaste, using pneumatic pressure and a dispenser for daily necessaries including the same.

BACKGROUND ART

In general, toothpaste widely used at home is contained in a soft tube type dispenser. Since the dispenser is squeezed to dispense a dose of the toothpaste, the tube is crushed according to the pushed position. Also, since contents are not wholly discharged, the contents are left on an inner surface of the tube.

In order to solve the above problems, a piston type airtight dispenser is disclosed in Korean Utility Model No. 0261356. The piston type airtight dispenser includes a cylinder having a plunger coupled to an inner upper end portion of a tubular body and airtightly moving downward by pressure applied from an upper portion; a lower plate airtightly coupled to a lower end portion of the cylinder and having a through-hole formed at a center portion and a working hole of a diameter larger than that of the through-hole at a lower end; an upper plate coupled to the upper end portion of the cylinder and having a plurality of suck holes; a dispensing plug engaged to the lower end portion of the working hole of the lower plate and having a dispensing hole formed at a center thereof; a check valve installed between the lower plate and the dispensing plug and opening the dispensing hole of the dispensing plug if the pressure is applied to the upper portion of the plunger in the cylinder while closing the dispensing hole if the pressure applied to the upper portion of the plunger is released; and a piston positioned on the upper portion of the plunger of the cylinder and moving the plunger downwards.

The piston includes a disc-shaped pressing plate closely contacting the inner periphery of the cylinder at the upper portion of the plunger and having an engaging hole with an inclined pressing surface formed at a center thereof; a pushing bar having at a lower end portion thereof a boss engaged with the engaging hole of the pressing plate, a pressing portion contacting the inclined pressing surface, and at an upper end portion thereof a pressing portion, a stepped portion being formed on a middle portion of a body; a restoring plate inserted in a body of the pushing bar and hooked in the stepped portion of the bottom of the body and having a plurality of through-holes; and a tension spring having one end engaged with a portion of the upper portion of the cylinder and the other end urging the restoring plate upwardly.

With the construction, when a user pushes down the pushing bar, the plunger is downwardly pushed by the pneumatic pressure to generate pressure. The check valve opens the dispensing hole of the dispensing plug in accordance with the pressure, so that the contents are dispensed outwardly from the dispenser through the dispensing hole.

In the piston type airtight dispenser, however, it is very difficult to employ the piston separated from the cylinder in other cylinder since the piston is integrally formed with the cylinder. Consequently, it is troublesome to disassemble the piston from the cylinder, in order to mount the piston in other cylinder having no piston.

More specifically, in order to make the use of the piston in other cylinder, firstly, after the upper plate is detached from the cylinder, the pressing bar integrally engaged with the restoring plate and the pressing plate is pulled up, and then the tension spring is disassembled from the upper portion of the cylinder, thereby disengaging the piston from the cylinder.

Consequently, the operation of separating the piston from the cylinder is complicated. Also, since the pushing bar and the tension spring which constitute the piston are separated from each other, the tension spring separated from the cylinder may be lost.

As described above, it is not easy to disengage the piston from the cylinder. Since most of the users do not effectively make the use of the piston in other cylinder, it is not effective in view of the recycle of resources. In case the dispenser is constructed not to be refilled with contents, the user should throw away the used dispenser, and then purchase a new dispenser having a piston, which imposes expenses on the user.

In addition, since the piston is constituted of many parts, such as the upper plate, the restoring plate, the pressing plate, the tension spring, and the like, the construction thereof is very complicated, thereby increasing its manufacturing cost.

DISCLOSURE OF INVENTION

Technical Problem

Accordingly, the present invention has been made to solve the above-mentioned problems occurring in the prior art while advantages achieved by the prior art are maintained intact.

One object of the present invention is to provide an air-pump type discharger capable of discharging a dose of contents, in which the discharger can be easily detached from a dispenser body, so as to improve assembling workability and recycle of resources and reduce economical burden of consumers.

Another object of the present invention is to provide an air-pump type discharger having a simple construction, in which a spring is installed within the discharger to prevent loss of the spring.

Still another object of the present invention is to provide a dispenser for daily necessaries including the air-pump type discharger described above.

Technical Solution

In order to accomplish the objects, there is provided an air-pump type discharger comprising a housing inserted in a dispenser body which is filled with contents therein, and provided with a plurality of air vent holes around a piston receiving portion formed on a bottom surface of the housing; a piston having a pushing part with an opened lower portion and inserted in an upper opening of the housing, and a connector extending from a bottom surface of the pushing part, inserted in the piston receiving portion, and contacting the bottom surface of the housing, in which an air passage is formed in the pushing part and the connector, through which air passes; and a spring, installed within the housing, for resiliently supporting the piston upwards.

Preferably, a first sealing groove is formed on an outer periphery of the housing contacting the dispenser body, which a first sealing member is installed in the first sealing groove to maintain airtightness between the dispenser body and the housing.

Also, a second sealing groove may be formed on an outer periphery of the pushing part contacting the housing, which a second sealing member is installed in the second sealing groove to maintain airtightness between the housing and the pushing part.

Preferably, the air passage has a diameter of about 0.3 mm to about 0.7 mm.

According to another aspect of the present invention, there is provided a dispenser for daily necessaries comprising a dispenser body storing contents and having a dispensing opening formed at one end portion thereof; a pad installed in the dispenser body to prevent leakage of the contents and slid along an inner periphery of the dispenser body by pressure; a plug for opening and closing the dispensing opening; and an air-pump type discharger according to any of the embodiments described above, in which the air-pump type discharger is detachably mounted on an upper portion of the pad to dispense a dose of the contents from the dispenser body.

Preferably, the plug is provided with a retainer so that the plug is held and kept by a holder.

ADVANTAGEOUS EFFECTS

With the above description, since the discharger is easily detached from the dispenser body, the assembling workability and the recycle of resources can be improved, and thus economical burden of consumers can be reduced. Also, since the spring is installed within the discharger, it can prevent loss of the spring.

BRIEF DESCRIPTION OF THE DRAWINGS

The above and other objects, features and advantages of the present invention will be more apparent from the following detailed description taken in conjunction with the accompanying drawings, in which:

FIG. 1 is a perspective view illustrating a dispenser for daily necessaries including an air-pump type discharger according to the present invention;

FIG. 2 is an exploded perspective view of the dispenser in FIG. 1;

FIG. 3 is an exploded perspective view illustrating the air-pump type discharger in FIG. 2;

FIG. 4 is a cross-sectional view illustrating the state in which the pushing part in FIG. 1 is not pressed; and FIG. 5 is a cross-sectional view illustrating the state in which a user pushes down the pushing part in FIG. 4.

BEST MODE FOR CARRYING OUT THE INVENTION

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

An air-pump type discharger according to some embodiments of the present invention is very suitable to the toothpaste dispenser disclosed in Koran Utility Model Application No. 2007-14712 which was filed by the applicant, but the present invention is not limited to these embodiments. That is, the air-pump type discharger of the present invention may be applied to any cylinder type dispenser.

FIG. 1 is a perspective view illustrating the dispenser for daily necessaries including an air-pump type discharger according to the present invention. FIG. 2 is an exploded perspective view of the dispenser in FIG. 1. As shown in the figures, the dispenser for daily necessaries, generally indicated by reference numeral 1, includes a dispenser body 10 for storing contents T (hereinafter referred to as toothpaste, such as toothpaste, shampoo, rinse or the like and having a dispensing opening 10*a* formed at a lower end portion thereof, a pad 20 installed in the dispenser body 10 and slid in the body by pressure, a plug 30 for opening and closing the dispensing opening 10*a*, and an air-pump type discharger 50 mounted on an upper portion of the pad 20 for dispensing a dose of the toothpaste T from the dispenser body 10.

The dispenser body 10 for storing the toothpaste T is formed in a cylindrical shape. In the bottom of the dispenser body 10, a dispensing opening 10*a* is positioned for ejecting the toothpaste T.

The pad 20 is slid along an inner wall of the dispenser body 10 by the operation of the air-pump type discharger 50 to press the toothpaste T towards the dispensing opening 10*a*. In this instance, the pad 20 is made of rubber material, so that airtightness is maintained between the pad 20 and the dispenser body 10 to prevent the toothpaste from being leaked outwardly. The pad 20 has the same shape as that of the lower end B of the dispenser body 10. As a result, when the pad 20 is pressed to the lower end B of the dispenser body 10, the toothpaste T can be wholly dispensed from the dispenser body 10.

The plug 30 is to open and close the dispensing opening 10*a*, and is preferably provided with a retainer 33 on the lower end portion thereof. In this instance, in case the dispenser 1 is held and kept by a holder, the plug 30 is left on the holder by the retainer 33 when the user holds up the dispenser body 10 for its use. Consequently, the user can directly squeeze the air-pump type discharger 50 to dispense the toothpaste on a toothbrush, without opening the plug 30, which improves the convenience in use.

The air-pump type discharger 50 includes, as shown in FIG. 3, a housing 60 having an upper opening 62, a piston 70 inserted through the upper opening 62 of the housing 60 and moved up and down along an inner periphery of the housing 60, and a spring 80 installed within the housing 60 for resiliently supporting the piston 70 upwards.

More specifically, the discharger 50 according to the present invention is easily disassembled from the dispenser body 10, so that the discharger 50 can be disconnected from the used dispenser body and then be connected to other dispenser body. Consequently, after the toothpaste is wholly used, the user may disconnect only the discharger 50 from the dispenser body 10, and then insert it in other dispenser body. It is effective in view of recycle of resources. Also, since the user may purchase only the dispenser body 10, it is economical from the standpoint of the consumer. In addition, since the spring 80 is installed in the discharger 50 of the present invention, there is not possibility of losing the spring, unlike the prior art in which a spring is installed separately from a pushing bar, and it is easily carried.

The construction of the airtight dispenser of the prior art is complicated since an upper plate and a restoring plate should be provided to operate the piston. Therefore, it leads to inconvenience in its manufacture because of the complicated construction. However, since the discharger 50 according to the present invention consists of the housing 60, the piston 70, and the spring 80, its construction is simple to reduce its manufacturing cost comprising a mold cost The lower end portion of the housing 60 is inserted in the upper end A of the dispenser body 10. In this instance, a first sealing groove 61 is formed on an outer periphery of the lower end portion of the housing 60, in which a first sealing member 81 is installed in the first sealing groove 61. A seat groove 10*b* (see FIG. 2) should be formed on the inner periphery of the upper end A of the dispenser body 10, on which the first sealing member 81 is seated. As a result, the airtight contact between the inner periphery of the dispenser body 10 and the housing 60 is obtained to prevent the air in a space Q (see FIG. 4) formed between the dispenser pad 20 and the air-pump type discharger 50 from being leaked outwardly. Consequently, because of no loss of pneumatic pressure, the pressure applied by the user is applied to the pad 20 to dispense a dose of the toothpaste T.

A flange 65 protrudes from a center portion of the outer periphery of the housing 60, so that the position of the housing is determined when the lower end portion of the housing 60 is inserted in the upper end A of the dispenser body 10.

A piston receiving portion 64 is formed on the center portion of the bottom surface of the housing 60 to receive a connector 75 of the piston 70, and a plurality of air vent holes 63 (see FIG. 4) are formed around the piston receiving portion 64.

The piston 70 is made of plastic, and has a pushing part 71 with an opened lower portion and inserted in the upper opening 62 of the housing 60, and the connector 75 extending from the bottom surface of the pushing part 71, inserted in the piston receiving portion 64, and contacting the bottom surface of the housing 60.

The pushing part 71 is pressed by the user to dispense a dose of the toothpaste T stored in the dispenser body 10. Preferably, the center portion of the pushing part 71 is depressed to enable the user to conveniently press the pushing part 71 using his or her finger. A second sealing groove 72 is formed around the pushing part 71 contacting the housing 60, in which a second sealing member 82 is installed. The airtightness between the inner periphery of the housing 60 and the piston 70 is maintained to prevent the air in a space P (see FIG. 4) formed between the housing 60 and the air-pump type discharger 50 from being leaked outwardly. As a result, because of no loss of pneumatic pressure, the air corresponding to the pressure applied by the user is moved from the space P to the space Q to press the pad 20 and thus dispense a dose of the toothpaste T as much as the corresponding volume.

The connector 75 of the piston 70 is composed of a body 76 extending downwardly from the bottom surface of the pushing part 71 and a catching portion 77 formed at a lower end portion of the body 76.

An air passage 79 is formed in the pushing part 71 and the connector 75, through which air passes. More specifically, the air passage 79 serves as not only a passage through which external air flows into the space Q of the dispenser body 10, but also a passage through which a small quantity of air is outwardly vent by instantly increased pressure in the space Q when the user takes off his or her finger from the piston 70, thereby preventing an unnecessary dose of the toothpaste from being dispensed by negative pressure applied to the dispensing opening 10*a*. In this embodiment, it is preferable that the air passage has a diameter of about 0.3 mm to 0.7 mm in order to prevent the air in the space Q from being vent outwardly when the user pushes down the piston 70 and to allow the air to smoothly flow in the space Q when the user takes off his or her finger from the piston 70. The diameter of the air passage 79 is not limited thereto, and may be determined according to specifications (for example, a volume of the dispenser body 10) of the dispenser body 10. By properly selecting the diameter of the air passage 49, it is possible to prevent an unnecessary dose of the toothpaste T from being dispensed after the piston 70 is pressed and to reduce its manufacturing cost, even though the prior construction such as a check valve is removed.

The catching portion 77 has a diameter slightly larger than that of the piston receiving portion 64. The catching portion 77 contacts the bottom surface of the housing 60 not to pass the housing 60 after the body 76 is inserted in the piston receiving portion 64. The catching portion 77 is formed by expanding the lower end portion of the body 76 in a circumference direction, and the catching portion 77 is made of plastic having desired tension. Therefore, the catching portion 77 is slightly contracted when the catching portion 77 passes through the piston receiving portion 64. If the catching portion 77 fully passes through the piston receiving portion 64, the catching portion 77 is restored so that it is caught by the bottom surface of the housing 60.

With the above construction, the principle of dispensing a dose of the toothpaste T from the dispenser 1 will now be described with reference to FIGS. 4 and 5.

Firstly, in order to assemble the air-pump type discharger 50 with the dispenser body 10, the lower end portion of the housing 60 is inserted in the upper end portion A of the dispenser body 10. The first sealing member 81 engaged to the housing 60 is seated on the groove 10*b* formed on the inner surface of the dispenser body 10 to maintain the airtightness between the housing 60 and the dispenser body 10.

Next, after the user opens the plug 30 from the dispensing opening 10*a* to use the toothpaste T, the user pushes down the pushing part 71 in a direction indicated by arrow F, with the air passage 79 being closed. As shown in FIG. 5, the piston 70 is downwardly slid along the inner surface of the housing 60, and the air passage 63 is opened. As such, the air in the space P is compressed, and is discharged to the space Q through the air passage 63 to press the pad 20. Then, the pad 20 is downwardly slid along the inner surface of the dispenser body 10 to dispense a dose of the toothpaste T through the dispensing opening 10*a*.

After that, when the user takes off his or her finger from the piston 70, the compressed spring 80 (as shown in FIG. 5) is restored by the restoring force, as shown in FIG. 4, to return the piston 70 to its original position. The space Q is filled with the external air as mush as the dispensed dose of the toothpaste T through the air passage 79, which forms the pneumatic pressure required for next operation.

Although preferred embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. An air-pump discharger comprising: a housing inserted in a dispenser body which is filled with contents therein, and provided with a plurality of air vent holes around a piston receiving portion formed on a bottom surface of the housing; a piston having a pushing part with an opened lower portion and inserted in an upper opening of the housing, and a connector extending from a bottom surface of the pushing part, inserted in the piston receiving portion, and contacting the bottom surface of the housing, in which an air passage is formed in the pushing part and the connector, through which air passes; and a spring, installed within the housing, for resiliently supporting the piston upwards.

2. The air-pump discharger as claimed in claim 1, wherein a first sealing groove is formed on an outer periphery of the housing contacting the dispenser body, which a first sealing member is installed in the first sealing groove to maintain airtightness between the dispenser body and the housing.

3. The air-pump discharger as claimed in claim 1, wherein a second sealing groove is formed on an outer periphery of the pushing part contacting the housing, which a second sealing member is installed in the second sealing groove to maintain airtightness between the housing and the pushing part.

4. The air-pump discharger as claimed in claim 1, wherein the air passage has a diameter of about 0.3 mm to 0.7 mm.

5. A dispenser for daily necessaries comprising: a dispenser body storing contents and having a dispensing opening formed at one end portion thereof; a pad installed in the dispenser body to prevent leakage of the contents and slid along an inner periphery of the dispenser body by pressure; a plug for opening and closing the dispensing opening; and an air-pump discharger according to any one of claims 1 to 4, in which the air-pump discharger is detachably mounted on an upper portion of the pad to dispense a dose of the contents from the dispenser body.

6. The dispenser as claimed in claim 5, wherein the plug is provided with a retainer so that the plug is held and kept by a holder.

* * * * *